US008258859B2

(12) United States Patent
Jinbo

(10) Patent No.: US 8,258,859 B2
(45) Date of Patent: Sep. 4, 2012

(54) VOLTAGE REDUCING CIRCUIT

(75) Inventor: Toshikatsu Jinbo, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 134 days.

(21) Appl. No.: 12/839,033

(22) Filed: Jul. 19, 2010

(65) Prior Publication Data

US 2011/0050186 A1 Mar. 3, 2011

(30) Foreign Application Priority Data

Aug. 28, 2009 (JP) ..... 2009-197541

(51) Int. Cl.
*G05F 1/10* (2006.01)

(52) U.S. Cl. ..... 327/540; 327/543

(58) Field of Classification Search ..... 327/538, 327/540, 543
See application file for complete search history.

(56) References Cited

U.S. PATENT DOCUMENTS

| | | | | |
|---|---|---|---|---|
| 5,936,443 | A | 8/1999 | Yasuda et al. | |
| 6,157,176 | A * | 12/2000 | Pulvirenti et al. | 323/266 |
| 6,515,461 | B2 | 2/2003 | Akiyama et al. | |
| 6,522,111 | B2 * | 2/2003 | Zadeh et al. | 323/277 |
| 6,642,791 | B1 * | 11/2003 | Balan | 330/253 |
| 6,933,772 | B1 * | 8/2005 | Banerjee et al. | 327/541 |
| 7,166,991 | B2 * | 1/2007 | Eberlein | 323/280 |
| 7,932,707 | B2 * | 4/2011 | Imura | 323/280 |
| 7,982,448 | B1 * | 7/2011 | Prasad et al. | 323/315 |
| 8,026,703 | B1 * | 9/2011 | Damaraju et al. | 323/275 |
| 8,026,708 | B2 * | 9/2011 | Imura | 323/285 |
| 2008/0218137 | A1 * | 9/2008 | Okuyama et al. | 323/273 |
| 2009/0009236 | A1 * | 1/2009 | Saitoh | 327/541 |
| 2011/0133707 | A1 * | 6/2011 | Giroud | 323/265 |

FOREIGN PATENT DOCUMENTS

| | | |
|---|---|---|
| JP | 9-153777 A | 6/1997 |
| JP | 2002-42467 A | 2/2002 |

* cited by examiner

*Primary Examiner* — Thomas J Hiltunen
(74) *Attorney, Agent, or Firm* — Foley & Lardner LLP

(57) ABSTRACT

A voltage reducing circuit includes an internal power supply section configured to reduce an external power supply voltage supplied from an external power supply to an internal power supply voltage which is lower than the external power supply voltage based on a reference voltage. A first current control section is configured to control a current flowing through the internal power supply section when the internal power supply voltage is lower than a setting voltage. A second current control section is configured to control the current flowing through the internal power supply section when the internal power supply voltage exceeds the setting voltage.

9 Claims, 7 Drawing Sheets

VOLTAGE REDUCING CIRCUIT

INCORPORATION BY REFERENCE

This patent application claims a priority on convention based on Japanese Patent Application No. 2009-197541 filed on Aug. 28, 2009. The disclosure thereof is incorporated herein by reference.

TECHNICAL FIELD

The present invention relates to a semiconductor device and more specifically to a voltage reducing circuit that reduces a voltage supplied from outside and supplies it to an internal circuit of a semiconductor device as an internal power supply voltage.

BACKGROUND ART

In a semiconductor device, cost reduction is achieved by increasing integration and reducing a chip size. For this purpose, miniaturization of a memory element and a transistor in the semiconductor device has been preceded.

With the miniaturization of the memory element and the transistor, a power supply voltage applied to the semiconductor device also needs to be lowered from the view of reliability. On the other hand, in order to maintain compatibility with existing products as product specifications of the semiconductor device, the power supply voltage supplied to the semiconductor device may be maintained to the same voltage as that in the existing products. For example, when the power supply voltage of 1.8V is externally supplied and an internal power supply voltage in the semiconductor device is 1.5V, the external power supply voltage of 1.8V needs to be reduced to the internal supply voltage of 1.5V.

FIG. 1 is a block diagram showing a configuration of a conventional semiconductor device disclosed in Patent Literature 1. The semiconductor device includes a reference voltage circuit 201, a voltage reducing circuit 202, and an internal circuit 203. The reference voltage circuit 201 outputs a reference voltage VREF to the voltage reducing circuit 202 based on an external power supply voltage VDD. The voltage reducing circuit 202 reduces the external power supply voltage VDD to the internal power supply voltage VDL based on the reference voltage VREF and outputs it to the internal circuit 203.

FIG. 2 shows a configuration of a conventional voltage reducing circuit disclosed in Patent Literature 2. Here, the conventional voltage reducing circuit corresponds to the voltage reducing circuit 202 described above.

The conventional voltage reducing circuit includes an internal power supply section 20 and a current control section 110. The internal power supply section 20 includes a differential circuit section 21 and a voltage supplying section 22. The differential circuit section 21 includes P-type MOSFET (which will be referred to as a "PMOS transistor", hereinafter) MP12 and MP13 and N-type MOSFET (which will be referred to as "NMOS transistors", hereinafter) MN12 and MN13.

The PMOS transistor MP12 has a source connected with a first external power supply voltage VDD and a drain connected with a first node N1. The PMOS transistor MP13 has a source connected with the first external power supply voltage VDD, a gate connected with a gate of the PMOS transistor MP12 and a drain. The NMOS transistor MN12 has a drain connected with the first node N1, a source connected with a second node N2, and a gate to which the reference voltage VREF is supplied so as to set an internal power supply voltage VDL. The NMOS transistor MN13 has a drain connected with a drain of the PMOS transistor MP13, a source connected with the second node N2, and a gate connected with a fourth node N4. The first node N1 is used as an output of the differential circuit section 21, and an output voltage VPG is outputted from the first node N1.

The voltage supplying section 22 includes a PMOS transistor MP14 and resistance elements R12 and R13. The PMOS transistor MP14 has a source connected with the first external power supply voltage VDD, a drain connected with a third node N3, and a gate connected with the first node N1, and supplied with the output voltage VPG from the differential circuit section 21. The resistance element R12 is connected between the third node N3 and the fourth node N4. The resistance element R13 is connected between the fourth node N4 and a second external power supply voltage (ground voltage) GND. The third node N3 is used as the output of the voltage supplying section 22, and the internal power supply voltage VDL is outputted from the third node N3.

When the voltage supplying section 22 does not include the resistance elements R12 and R13, the third node N3 is connected to the gate of the NMOS transistor MN13 in place of the fourth node N4.

The current control section 110 includes a PMOS transistor MP11, a resistance element R11, and NMOS transistors MN11 and MN14. The PMOS transistor MP11 has a source connected with the first external power supply voltage VDD and a gate connected with the second power supply voltage GND. The NMOS transistor MN11 has a source connected with the second power supply voltage GND. The resistance element R11 is connected between a drain of the PMOS transistor MP11 and a drain of the NMOS transistor MN11. The NMOS transistor MN14 is a constant current source and has a drain connected with the second node N2 of the differential circuit section 21, a source connected with the second power supply voltage GND, and a gate connected with a gate and the drain of the NMOS transistor MN11.

Next, an operation of the conventional voltage reducing circuit will be described.

The internal power supply voltage VDL can be set based on the reference voltage VREF and a division voltage VMON. The reference voltage VREF serves as an input of the differential circuit section 21, and is supplied to the gate of the NMOS transistor MN12 of the differential circuit section 21 as described above. The division voltage VMON is a voltage supplied from the fourth node N4 when the internal power supply voltage VDL is divided by use of the resistance elements R12 and R13. That is, the division voltage VMON is supplied to the gate of the NMOS transistor MN13 of the differential circuit section 21. In this case, the division voltage VMON is expressed as follows:

$$VMON=VDL\times R13/(R12+R13)$$

In the differential circuit section 21, the division voltage VMON is made stable in the same voltage as the reference voltage VREF, and thus relation between the reference voltage VREF and the division voltage VMON is expressed as:

VREF=VMON=VDL×R13/(R12+R13). Developing this, the internal power supply voltage VDL is expressed as:

$$VDL=VREF\times(R12+R13)/R13.$$

When the external power supply voltage VDD is 1.8V and the internal power supply voltage VDL is 1.5V, it could be understood from the above equation that it is sufficient that the reference voltage VREF is set to be 0.75V and resistance values of the resistance elements R12 and R13 are equal to each other.

A configuration could be considered that the resistance elements R12 and R13 are not arranged and the internal power supply voltage VDL is directly connected to the gate of the NMOS transistor MN 13. In such a case, VREF=VDL.

FIG. 3 is a diagram showing a time-voltage characteristic in an operation of the conventional voltage reducing circuit. In FIG. 3, a horizontal axis shows time and a vertical axis shows voltage.

When the reference voltage VREF is set to be 0.75V after the external power supply voltage VDD is supplied, a current flows through a path from the power supply voltage VDD to the PMOS transistor MP11, the resistance element R11 and the NMOS transistor MN11 in the current control section 110, and a voltage VNG supplied to a gate of the NMOS transistor MN11 increases. As a result, the NMOS transistor MN14 is turned on so that the differential circuit section 21 is activated, which increases the internal power supply voltage VDL from the power supply voltage GND.

At this time, the division voltage VMON also increases with the increase in the internal power supply voltage VDL. When the internal power supply voltage VDL has increased to 1.5V, the division voltage VMON is set to be 0.75V, in which case the reference voltage VREF is equal to the division voltage VMON, so that the internal power supply voltage VDL is consequently controlled at 1.5V.

Citation List

[Patent Literature 1]: JP-A-Heisei 9-153777
[Patent Literature 2]: JP 2002-42467A

SUMMARY OF THE INVENTION

The conventional voltage reducing circuit controls the internal power supply voltage VDL by referring to the reference voltage VREF, and has an advantage that even when the external power supply voltage VDD changes, for example, even when the external power supply voltage VDD changes to 1.6V or 2.0V while a standard state of the external power supply voltage VDD is 1.8V, the internal power supply voltage VDL can be kept at 1.5V, thereby achieving a stable operation of the internal circuit 203.

In the conventional voltage reducing circuit, a current flowing through the differential circuit section 21 is controlled by the current control section 110. Thus, the response characteristic varies depending on an amount of the current flowing through the differential circuit section 21, and the influence is exerted on stability of the internal power supply voltage VDL. Moreover, a current consumption amount of the differential circuit section 21 also consequently varies. Therefore, it is preferable that a characteristic of the current control section 110 does not change.

However, since the current control section 110 in the conventional voltage reducing circuit includes the PMOS transistor MP11, the resistance element R11 and the NMOS transistor MN11 which are connected in series between the first external power supply voltage VDD and the second external power supply voltage GND, the change in the external power supply voltage VDD raises a problem that a current value controlled by the current control section 110 varies.

FIG. 4 is a diagram showing a voltage-current characteristic of the current control section 110 of the conventional voltage reducing circuit. In FIG. 4, a horizontal axis shows voltage (corresponding to the external power supply voltage VDD) and a vertical axis shows current. Here, it is assumed that the gate of the PMOS transistor MP11 is in the voltage GND and impedance is sufficiently low to an ignorable degree.

If a resistance value of the resistance element R11 of the current control section 110 is 10 KΩ, a voltage-current characteristic of the resistance element R11 are expressed by IR16V (VDD=1.6V), IR18V (VDD=1.8V), and IR20V (VDD=2.0V), which are respectively indicated by straight lines.

Moreover, if the horizontal axis shows a voltage of the drain and the gate of the NMOS transistor MN11, a current characteristic of the NMOS transistor MN11 is expressed by IMN 11, which is indicated by a curved line.

In this case, an actual value of the current flowing through the current control section 110 is determined by use of intersection points of the characteristics IR16, IR18, and IR20 of the resistance element R11 and the characteristic IMN11 of the NMOS transistor MN11. In this example, a current value of the current control section 110 varies from 75 μA to 105 μA with the external power supply voltage VDD varied in a range from 1.6V to 2.0V, which adversely influences a stable operation of the voltage reducing circuit.

Considering such a change in the current control section 110 due to the change in the external power supply voltage VDD, countermeasures are taken at a design stage by setting the current flowing through the current control section 110 to a larger current to ensure responsibility of the differential circuit section 21. However, a current consumption amount of the voltage reducing circuit increases.

In an aspect of the present invention, a voltage reducing circuit includes: an internal power supply section configured to reduce an external power supply voltage supplied from an external power supply to an internal power supply voltage which is lower than the external power supply voltage based on a reference voltage. A first current control section is configured to control a current flowing through the internal power supply section when the internal power supply voltage is lower than a setting voltage. A second current control section is configured to control the current flowing through the internal power supply section when the internal power supply voltage exceeds the setting voltage.

In another aspect of the present invention, a semiconductor device includes: an internal circuit; and the voltage reducing circuit described above.

In the voltage reducing circuit of the present invention, by the above configuration, the current flowing through the differential circuit section 21 is controlled to be a constant current value without receiving any influence of the change in the external power supply voltage VDD. That is, the configuration can ensure the stable operation.

In the voltage reducing circuit of the present invention, also the above configuration does not require a design considering the change in the external power supply voltage VDD, unlike the conventional voltage reducing circuit, and thus also does not require setting the current consumption amount of the voltage reducing circuit to be larger, thereby contributing to reducing the current consumption amount.

BRIEF DESCRIPTION OF THE DRAWINGS

The above and other objects, advantages and features of the present invention will be more apparent from the following description of certain embodiments taken in conjunction with the accompanying drawings, in which.

DESCRIPTION OF EMBODIMENTS

Hereinafter, a voltage reducing circuit according to the present invention will be described in detail with reference to the attached drawings.

First Embodiment

Figure 1:
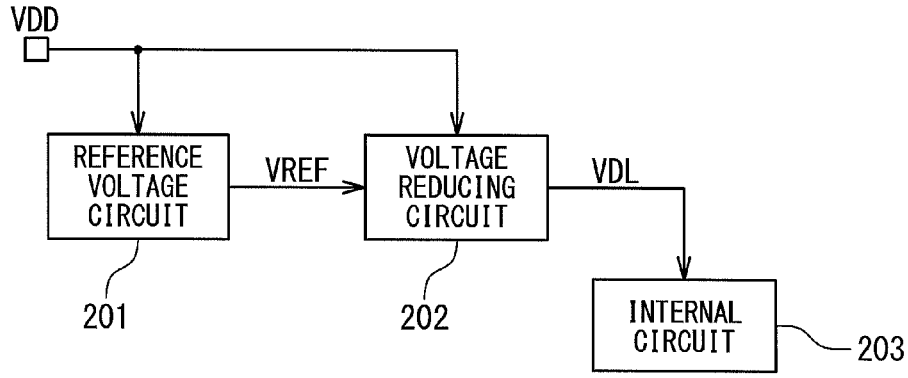
Fig. 1 CONVENTIONAL ART
FIG. 1 is a block diagram showing a configuration of a conventional semiconductor device.
Figure 2:
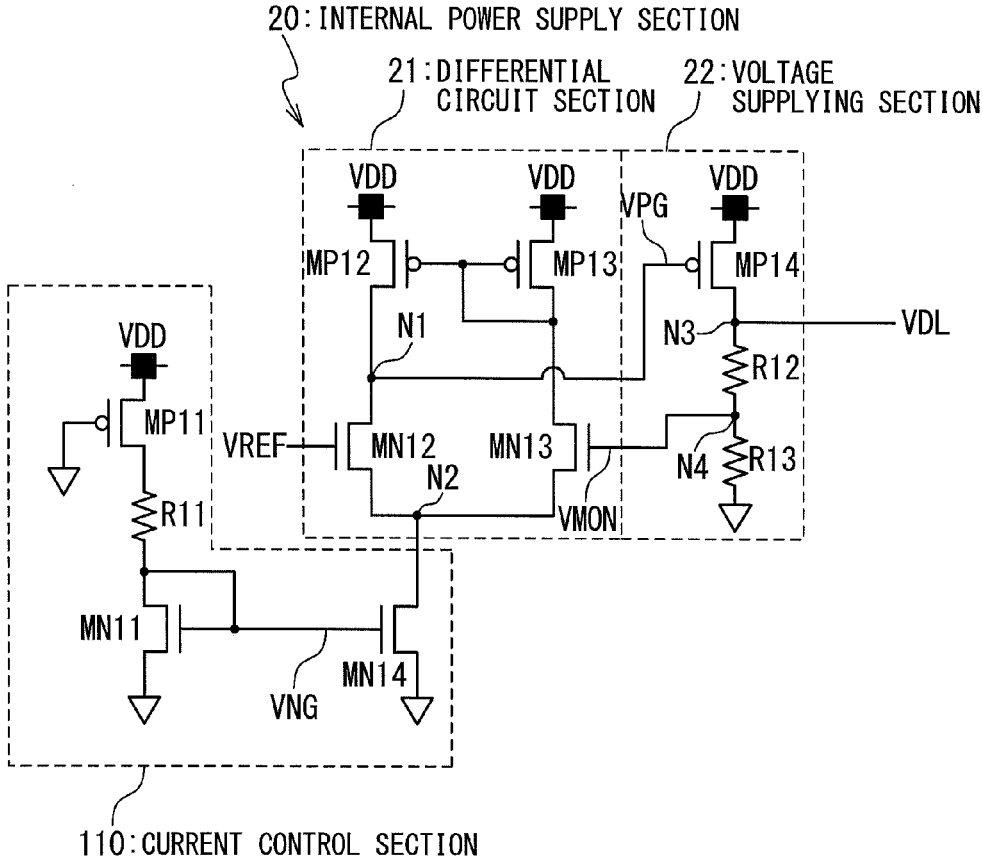
Fig. 2 CONVENTIONAL ART
FIG. 2 shows a configuration of a conventional voltage reducing circuit.
Figure 3:
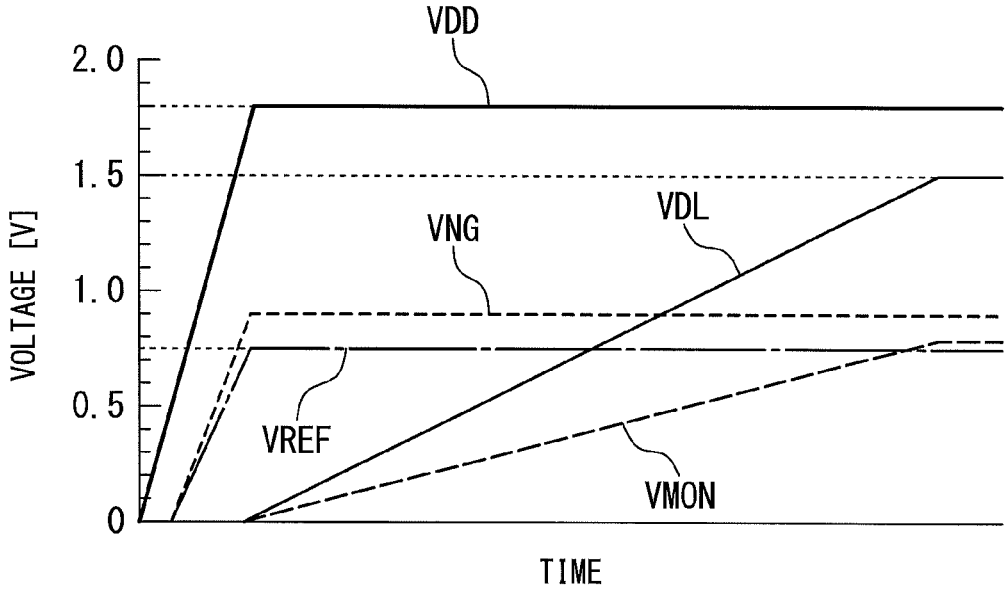
Fig. 3 CONVENTIONAL ART
FIG. 3 is a diagram showing time-voltage characteristics in an operation of the conventional voltage reducing circuit.
Figure 4:
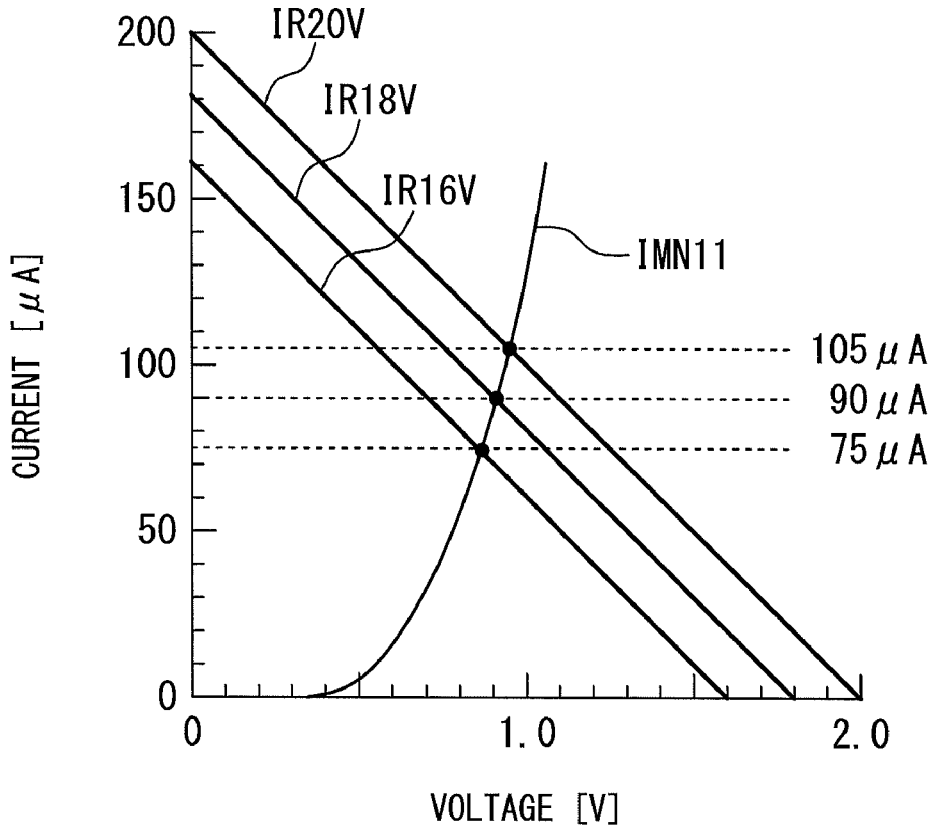
Fig. 4 CONVENTIONAL ART
FIG. 4 is a diagram showing voltage-current characteristics of a current control section of the conventional voltage reducing circuit.
Figure 5:
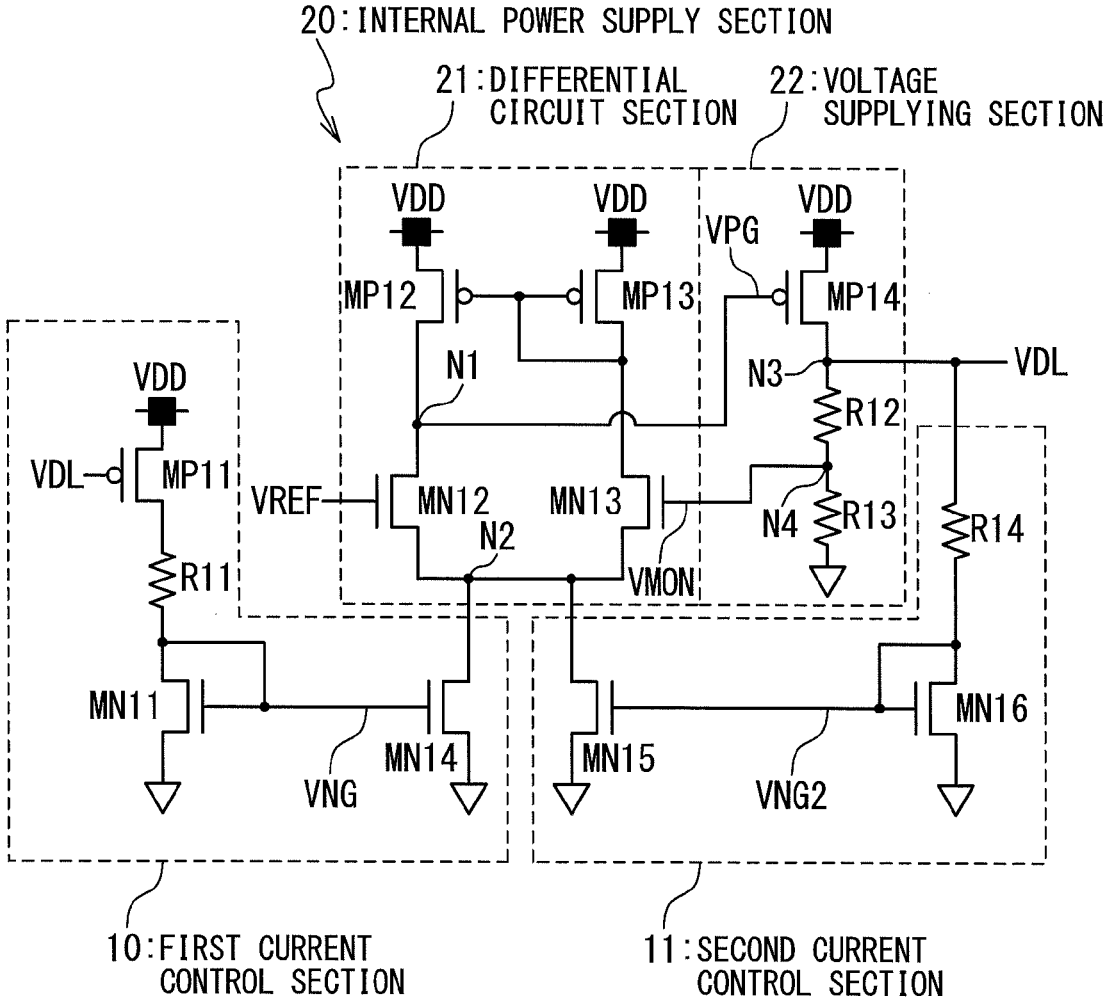
FIG. 5 is a circuit diagram showing a configuration of a voltage reducing circuit according to a first embodiment of the present invention.

FIG. 5 shows a configuration of the voltage reducing circuit according to a first embodiment of the present invention. The voltage reducing circuit in the first embodiment is applied to a semiconductor device (see FIG. 1). In this case, the voltage reducing circuit in the first embodiment corresponds to the voltage reducing circuit 202 of the semiconductor device.

The voltage reducing circuit according to the first embodiment of the present invention includes a first current control section 10, a second current control section 11, and an internal power supply section 20. The first current control section 10 includes a first P-channel MOSFET (to be referred to as a "PMOS transistor", hereinafter) MP11, first and second N-channel MOSFETs (to be referred to as "NMOS transistors" hereinafter) MN11 and MN14, and a first resistance element R11. The second control section 11 includes third and fourth NMOS transistors MN16 and MN15 and a second resistance element R14.

The internal power supply section 20 includes a differential circuit section 21 and a voltage supplying section 22. The differential circuit section 21 includes second and third PMOS transistors MP12 and MP13 and fifth and sixth NMOS transistors MN12 and MN13. The voltage supplying section 22 includes a fourth PMOS transistor MP14 and third and fourth resistance elements R12 and R13.

Components and connection of the differential circuit section 21 and the voltage supplying section 22 are the same as those of the differential circuit section 21 and the voltage supplying section 22 in the conventional voltage reducing circuit. That is, the differential circuit section 21 includes PMOS transistors MP12 and MP13 and NMOS transistors MN12 and MN13.

The PMOS transistor MP12 has a source connected with a first external power supply voltage VDD and a drain connected with a first node N1. The PMOS transistor MP13 has a source connected with the first external power supply voltage VDD, a gate connected with a gate of the PMOS transistor MP12 and a drain. The NMOS transistor MN12 has a drain connected with the first node N1, a source connected with a second node N2, and a gate to which the reference voltage VREF is supplied so as to set an internal power supply voltage VDL. The NMOS transistor MN13 has a drain connected with a drain of the PMOS transistor MP13, a source connected with the second node N2, and a gate connected with a fourth node N4. The first node N1 is used as an output of the differential circuit section 21, and an output voltage VPG is outputted from the first node N1.

The voltage supplying section 22 includes a PMOS transistor MP14 and resistance elements R12 and R13. The PMOS transistor MP14 has a source connected with the first external power supply voltage VDD, drain connected with a third node N3, and a gate connected with the first node N1, and supplied with the output voltage VPG from the differential circuit section 21. The resistance element R12 is connected between the third node N3 and the fourth node N4. The resistance element R13 is connected between the fourth node N4 and a second external power supply voltage (ground voltage) GND. The third node N3 is used as the output of the voltage supplying section 22, and the internal power supply voltage VDL is outputted from the third node N3.

When the voltage supplying section 22 does not include the resistance elements R12 and R13, the third node N3 is connected to the gate of the NMOS transistor MN13 in place of the fourth node N4.

In the first current control section 10, the PMOS transistor MP11 has a source connected with a first external power supply voltage VDD and a gate connected with an output of the voltage supplying section 22 (third node N3), and supplied with an internal power supply voltage VDL from the voltage supplying section 22. The NMOS transistor MN11 has a source connected with a second external power supply voltage GND. The resistance element R11 is connected between a drain of the transistor MP11 and a drain of the NMOS transistor MN11. The NMOS transistor MN14 functions as a first constant current source, and has a drain connected with a second node N2 of the differential circuit section 21, a source connected with the second external power supply voltage GND, and a gate connected with a gate and the drain of the NMOS transistor MN11. That is, in the first current control section 10, the internal power supply voltage VDL is supplied to the gate of the PMOS transistor MP11, unlike the conventional current control section 110.

The second current control section 11 is newly added to the conventional voltage reducing circuit and has the internal power supply voltage VDL as its power supply voltage.

In the second current control section 11, the NMOS transistor MN16 has a source connected with the second external power supply voltage GND. The resistance element R14 is connected between the output (third node N3) of the voltage supplying section 22 and a drain of the NMOS transistor MN16, and is supplied with the internal power supply voltage VDL from the voltage supplying section 22. The NMOS transistor MN15 is a second constant current source, and has a drain connected with the second node N2 of the differential circuit section 21, a source connected with the second external power supply voltage GND, and a gate connected with a gate and the drain of the NMOS transistor MN16.

Next, an operation of the voltage reducing circuit according to the first embodiment of the present invention will be described.

Figure 6A:
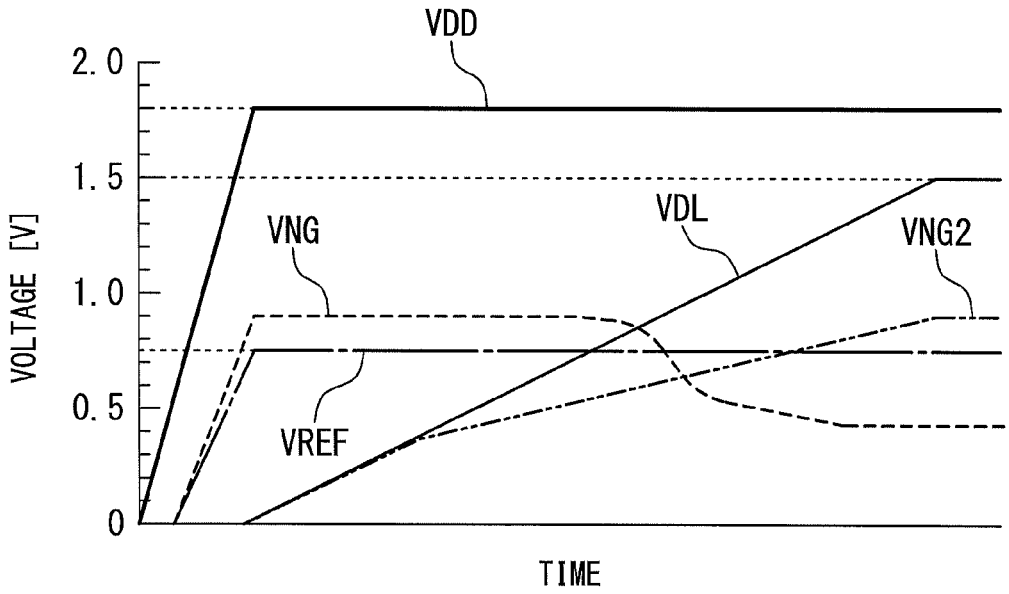
FIG. 6A is a diagram showing time-voltage characteristics in an operation of the voltage reducing circuit according to the first embodiment of the present invention.
Figure 6B:
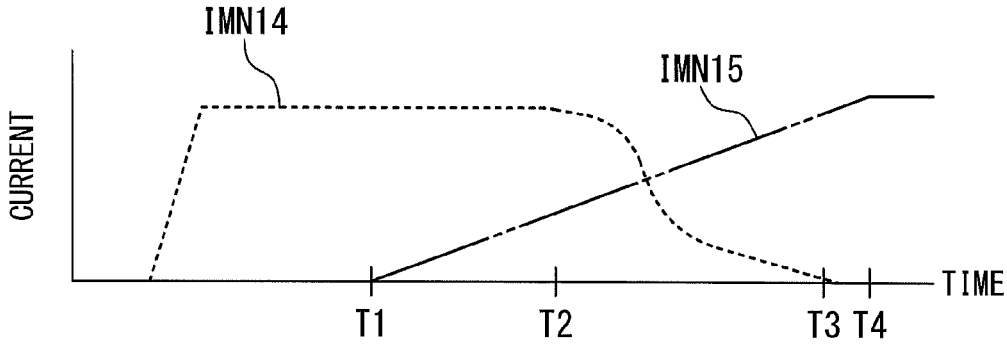
FIG. 6B is a diagram showing time-current characteristics showing the operation of the voltage reducing circuit according to the first embodiment of the present invention.

FIG. 6A shows time-voltage characteristics in the operation of the voltage reducing circuit according to the first embodiment of the present invention, and FIG. 6B shows time-current characteristics in this operation. In FIG. 6A, a horizontal axis shows time and a vertical axis shows voltage. In FIG. 6B, a horizontal axis shows time and a vertical axis shows current. Here, a current characteristic of the NMOS transistor MN14 of the first current control section 10 is expressed by IMN14, and a current characteristic of the NMOS transistor MN15 of the second current control section 11 is expressed by IMN15.

When the reference voltage VREF is set to be 0.75V after an external power supply voltage VDD is supplied, a current flows through a path from the external power supply voltage VDD to the PMOS transistor MP11, the resistance elements R11, and the NMOS transistor MN11, and the voltage VNG supplied to the gate of the NMOS transistor MN11 increases in the first control section 10. As a result, the NMOS transistor MN14 is turned on, to activate the differential circuit section 21, which increases the internal power supply voltage VDL through the PMOS transistor MP14 from the external power supply voltage VDD.

Then, when the internal power supply voltage VDL has increased so as to be higher than a threshold value (for example, 0.4V) of the NMOS transistor MN16 of the second current control section 11, the NMOS transistor MN16 transits to a conductive state so that the current starts to flow through the second current control section 11. At this time, a voltage VNG2 supplied to the gate of the NMOS transistor MN15 increases (time T1).

When the internal power supply voltage VDL further has increased, the voltage at the gate of the PMOS transistor MP11 of the first current control section 10 increases, and impedance of the PMOS transistor MP11 increases, so that the current flowing through the first current control section 10 starts to decrease (time T2).

Then, when the internal power supply voltage VDL increases and has exceeded the set voltage (1.4V) while the external power supply voltage VDD is 1.8V (the threshold voltage of the PMOS transistor MP11 is −0.4V and a setting voltage is 1.4V), a voltage difference between the gate and the source in the PMOS transistor MP11 becomes less than the threshold voltage, so that the PMOS transistor MP11 is turned off and the NMOS transistor MN14 of the first current control section 10 is also turned off. Thus, no current flows through the first current control section 10 (time T3).

On the other hand, in the second current control section 11, when the current increases with the increase in the internal power supply voltage VDL, and the internal power supply voltage VDL increases to the control level of 1.5V, a desired constant current consequently flows (time T4).

As described above, in the voltage reducing circuit according to the first embodiment of the present invention, the differential circuit section 21 of the internal power supply section 20 outputs an output voltage VPG based on the reference voltage VREF, and the voltage supplying section 22 reduces the voltage from the external power supply voltage VDD to the internal power supply voltage VDL in accordance with the output voltage VPG. The first current control section 10 controls a current flowing through the differential circuit section 21 when the internal power supply voltage VDL is equal to or lower than the setting voltage, and stops the control of the current flowing through the differential circuit section 21 when the internal power supply voltage VDL exceeds the setting voltage. On the other hand, the second current control section 11 has the internal power supply voltage VDL as its power supply, and controls the current flowing through the differential circuit section 21 when the internal power supply voltage VDL exceeds the setting voltage.

Therefore, in the voltage reducing circuit according to the first embodiment of the present invention, the current flowing through the differential circuit section 21 is controlled to be a constant current value without any influence from a change in the external power supply voltage VDD. That is, the configuration can ensure stable operation.

Moreover, in the voltage reducing circuit according to the first embodiment of the present invention, the design in consideration of the change in the external power supply voltage VDD is not required, and thus also a current consumption amount of the voltage reducing circuit needs not to be set larger, thereby contributing to reducing the current consumption amount.

Second Embodiment

Figure 7:
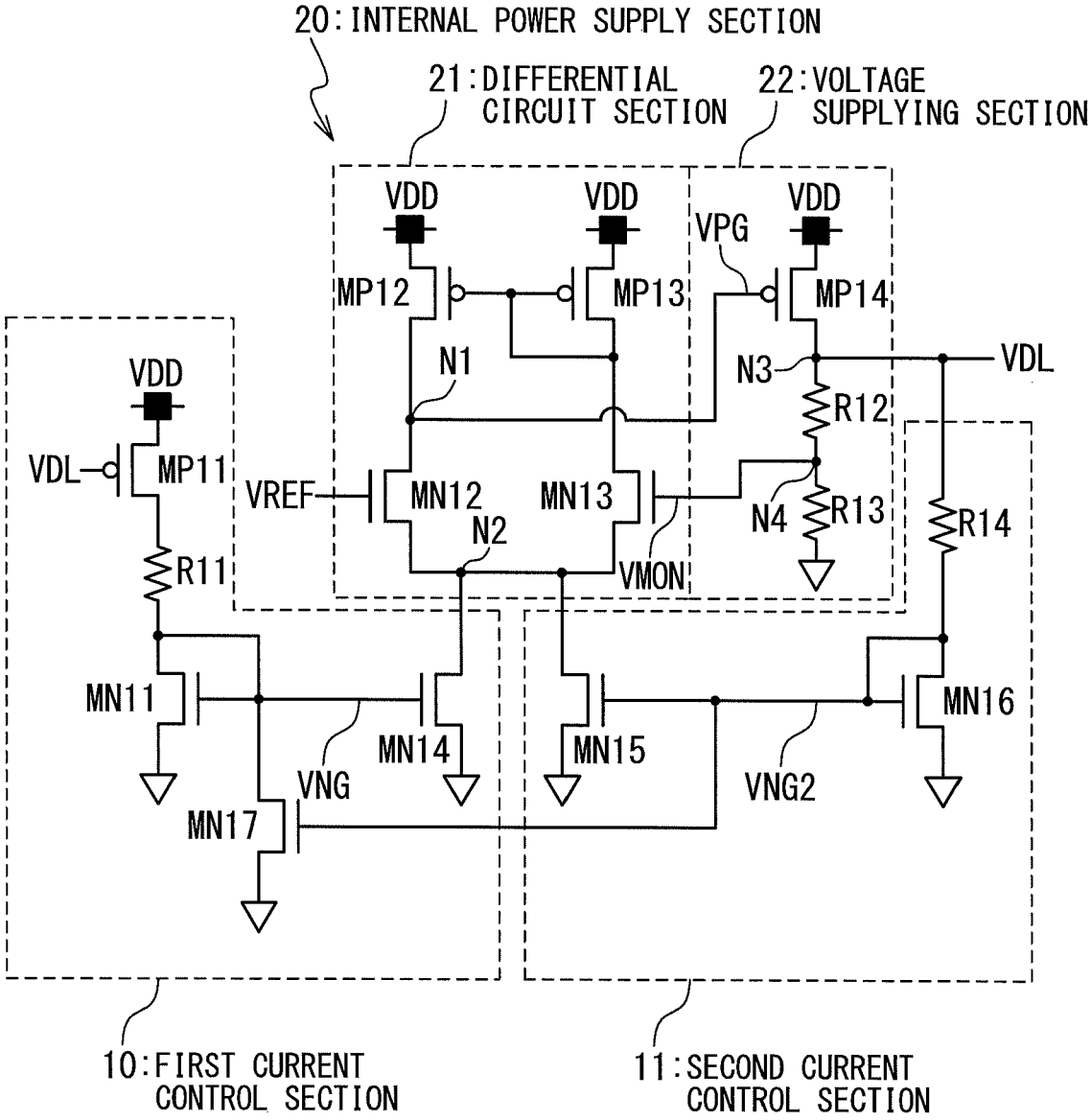
FIG. 7 is a circuit diagram showing the configuration of the voltage reducing circuit according to a second embodiment of the present invention.

FIG. 7 is a circuit diagram showing the configuration of the voltage reducing circuit according to a second embodiment of the present invention. In the second embodiment, a description overlapping with that of the first embodiment will be omitted.

The first current control section 10 further includes an NMOS transistor MN17. The NMOS transistor MN17 has a drain connected with a drain of the NMOS transistor MN11, a source connected with a second external power supply voltage GND, and a gate connected with a drain of the NMOS transistor MN16 of the second current control section 11.

Here, the NMOS transistor MN17 is provided in the first current control section 10, but may be provided in the second current control section 11 if the same connection relation applies.

Next, an operation of the voltage reducing circuit according to the second embodiment of the present invention will be described.

Figure 8A:
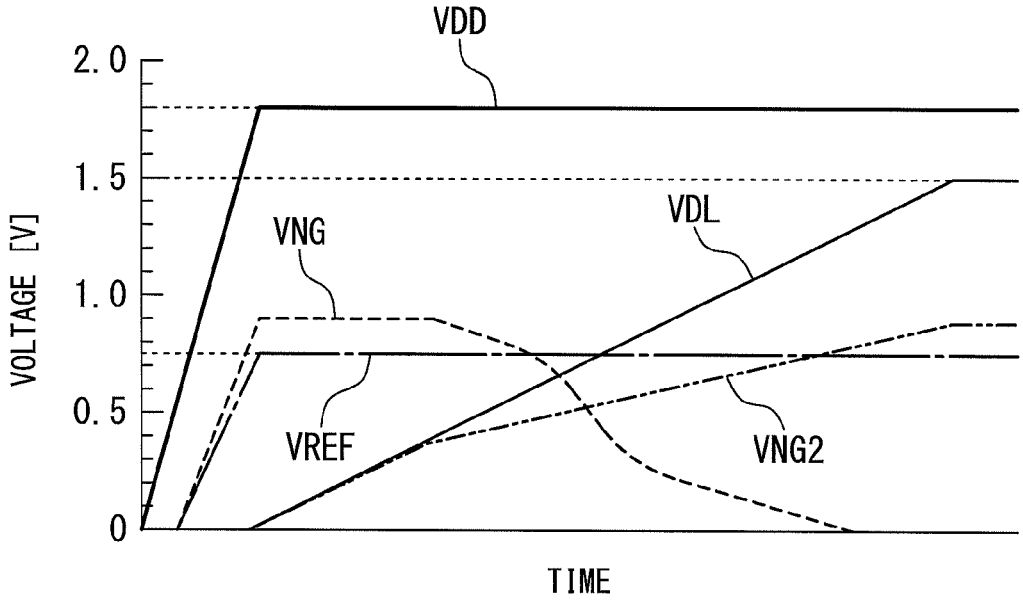
FIG. 8A illustrates time-voltage characteristics in an operation of the voltage reducing circuit according to the second embodiment of the present invention.
Figure 8B:
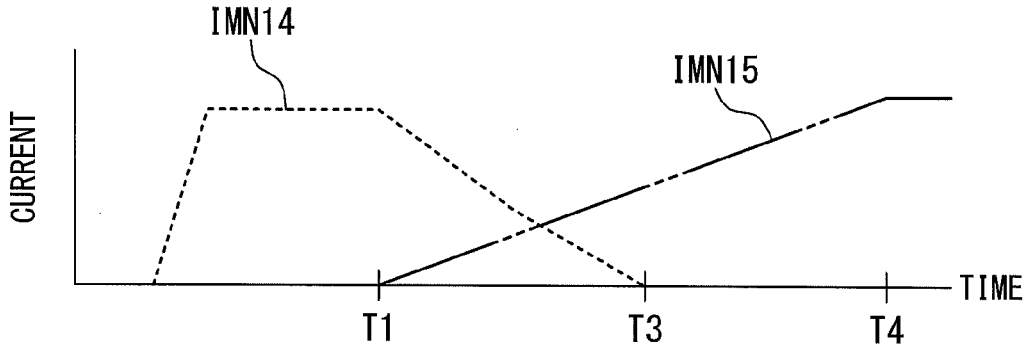
FIG. 8B illustrates time-current characteristics in the operation of the voltage reducing circuit according to the second embodiment of the present invention.

FIG. 8A illustrates time-voltage characteristics showing the operation of the voltage reducing circuit according to the second embodiment of the present invention. FIG. 8B illustrates time-current characteristics showing this operation. In FIG. 8A, a horizontal axis shows time and a vertical axis shows voltage. In FIG. 8B, a horizontal axis shows time and a vertical axis shows current. Here, a current characteristic of the NMOS transistor MN14 of the first current control section 10 is expressed by IMN14, and a current characteristic of the NMOS transistor MN15 of the second current control section 11 is expressed by IMN15.

The operation up to time T1 is the same as that of the first embodiment.

After the time T1, a current starts to flow through the second current control section 11, and the NMOS transistor MN17 of the first current control section 10 is turned on, which decreases the voltage VNG supplied to a gate of the NMOS transistor MN11, so that a current flowing through the first current control section 10 starts to decrease at the time T1.

Then, when the voltage VNG has decreased to a threshold value (for example, 0.4V) of the NMOS transistor MN14 by the NMOS transistor MN17, the NMOS transistor MN14 is turned off, which no longer contributes to control of the current flowing through the differential circuit section 21 (time T3).

On the other hand, in the second current control section 11, when the current increases with an increase in the internal power supply voltage VDL, and the internal power supply voltage VDL has increased to the control level of 1.5V, a desired constant current flows (time T4).

As described above, in the voltage reducing circuit according to the second embodiment of the present invention, by providing the NMOS transistor MN17 in the first current control section 10 or the second current control section 11, a current value of the first current control section 10 is decreased in response to the current flowing through the second current control section 11.

Therefore, with the voltage reducing circuit according to the second embodiment of the present invention, an overall current value in a period during which the first current control section 10 and the second current control section 11 are simultaneously activated, that is, a current value as an intersection point of the current characteristic IMN14 and the current characteristic IMN15 is not more than that of the first embodiment, so that the current control on the differential circuit section 21 can be smoothly transferred from the first current control section 10 to the second current control section 11.

Although the present invention has been described above in connection with several embodiments thereof, it would be apparent to those skilled in the art that those embodiments are provided solely for illustrating the present invention, and should not be relied upon to construe the appended claims in a limiting sense.

What is claimed is:

1. A voltage reducing circuit comprising:

an internal power supply section configured to reduce an external power supply voltage supplied from an external power supply to an internal power supply voltage which is lower than said external power supply voltage based on a reference voltage;

a first current control section configured to control a current flowing through said internal power supply section when said internal power supply voltage is lower than a setting voltage; and a second current control section configured to control the current flowing through said internal power supply section when said internal power supply voltage exceeds the setting voltage;

wherein said internal power supply section comprises:

a differential circuit section configured to output an output voltage based on said reference voltage; and a voltage supplying section configured to generate said internal power supply voltage from said external power supply voltage based on said output voltage, wherein said first current control section controls the current flowing through said differential circuit section when said internal power supply voltage is lower than said setting voltage, and stops the control of the current flowing through said differential circuit section when said internal power supply voltage exceeds said setting voltage, and wherein said second current control section uses said internal power supply voltage as a power supply voltage, and controls the current flowing through said differential circuit section when said internal power supply voltage exceeds said setting voltage.

2. The voltage reducing circuit according to claim 1, wherein said first current control section comprises:

a first PMOS transistor having a source connected with a first external power supply to be supplied with a first external power supply voltage as said external power supply voltage, and a gate connected with an output of said voltage supplying section to supply said internal power supply voltage from said voltage supplying section;

a first NMOS transistor having a source connected with a second external power supply to be supplied with a second external power supply voltage which is lower than said internal power supply voltage;

a first resistance element connected between a drain of said first PMOS transistor and a drain of said first NMOS transistor; and a second NMOS transistor, as said first constant current source, having a drain connected with said differential circuit section, a source connected with said second external power supply and a gate connected with a gate and a drain of said first NMOS transistor, wherein said second current control section comprises:

a third NMOS transistor having a source connected with said second external power supply;

a second resistance element connected between an output of said voltage supplying section and a drain of said third NMOS transistor, and supplied with said internal power supply voltage from said voltage supplying section; and a fourth NMOS transistor as said second constant current source, having a drain connected with said differential circuit section, a source connected with said second external power supply, and a gate connected with a gate and the drain of said third NMOS transistor.

3. The voltage reducing circuit according to claim 2, wherein said differential circuit section comprises:

a second PMOS transistor having a source connected with said first external power supply and a drain connected with a first node;

a third PMOS transistor having a source connected with said first external power supply and a gate connected with a gate and the drain of said second PMOS transistor;

a fifth NMOS transistor having a drain connected with said first node, a source connected with a second node and a gate supplied with said reference voltage; and a sixth NMOS transistor having a drain connected with the drain of said third PMOS transistor, a source connected with said second node, and a gate connected with a third node, wherein said voltage supplying section comprises:

a fourth PMOS transistor having a source connected with said first external power supply, a drain connected with said third node and a gate connected with said first node and supplied with said output voltage from said differential circuit section, wherein said first node is used as an output of said differential circuit section and said output voltage is outputted from said first node, wherein said second node is connected with the drain of said second NMOS transistor of said first current control section and the drain of said fourth NMOS transistor of said second current control section, and wherein said third node is used as an output of said voltage supplying section and said internal power supply voltage is outputted from said third node.

4. The voltage reducing circuit according to claim 3, wherein said voltage supplying section comprises:

a third resistance element connected between said third node and a fourth node; and a fourth resistance element connected between said fourth node and said second external power supply, wherein said fourth node is connected with the gate of said sixth NMOS transistor in place of said third node.

5. The voltage reducing circuit according to claim 2, further comprising:

a seventh NMOS transistor having a drain connected with the drain of said first NMOS transistor of said first current control section, a source connected with said second external power supply and a gate connected with the drain of said third NMOS transistor of said second current control section.

6. The voltage reducing circuit according to claim 5, wherein said seventh NMOS transistor is provided for said first current control section.

7. The voltage reducing circuit according to claim 5, wherein said seventh NMOS transistor is provided for said second current control section.

8. A semiconductor device comprising:

an internal circuit; and a voltage reducing circuit, wherein said voltage reducing circuit comprises:

an internal power supply section configured to reduce an external power supply voltage supplied from an external power supply to an internal power supply voltage which is lower than said external power supply voltage based on a reference voltage and supply said internal power supply voltage to said internal circuit;

a first current control section configured to control a current flowing through said internal power supply section when said internal power supply voltage is lower than a setting voltage; and a second current control section configured to control the current flowing through said internal power supply section when said internal power supply voltage exceeds the setting voltage;

wherein said internal power supply section comprises:

a differential circuit section configured to output an output voltage based on said reference voltage; and a voltage supplying section configured to generate said internal power supply voltage from said external power supply voltage based on said output voltage, wherein said first current control section controls the current flowing through said differential circuit section when said internal power supply voltage is lower than said setting voltage, and stops the control of the current flowing through said differential circuit section when said internal power supply voltage exceeds said setting voltage, and wherein said second current control section uses said internal power supply voltage as a power supply voltage, and controls the current flowing through said differential circuit section when said internal power supply voltage exceeds said setting voltage.

9. The semiconductor device according to claim 8, further comprising:

a reference voltage circuit configured to output said reference voltage to said voltage reducing circuit based on said external power supply voltage.

* * * * *